United States Patent [19]

Pell

[11] 3,951,268

[45] Apr. 20, 1976

[54] METHOD AND APPARATUS FOR CHANGING ROLLS FOR A ROLLING MILL

[75] Inventor: Raymond H. Pell, Chesterton, Ind.

[73] Assignee: National Steel Corporation, Pittsburgh, Pa.

[22] Filed: Jan. 7, 1974

[21] Appl. No.: 431,320

[52] U.S. Cl. ..... 211/13

[51] Int. Cl.[2] ..... F16M 13/00

[58] Field of Search..... 211/13, 60 R, 60 S, 211/64, 69.1; 248/201

[56] References Cited

UNITED STATES PATENTS

| | | | |
|---|---|---|---|
| 429,421 | 6/1890 | Coit | 211/60 R |
| 767,101 | 8/1904 | Brown | 211/60 R |
| 991,736 | 5/1911 | Minnick | 211/60 R |
| 1,334,545 | 3/1920 | Londelius | 211/60 R |
| 2,285,632 | 6/1942 | Urbain | 211/60 R |
| 2,946,452 | 7/1960 | Caloiero et al. | 211/64 |
| 3,288,304 | 11/1966 | Graves | 211/64 |

FOREIGN PATENTS OR APPLICATIONS

| | | | |
|---|---|---|---|
| 85,201 | 5/1955 | Norway | 211/60 R |

*Primary Examiner*—William H. Schultz
*Attorney, Agent, or Firm*—Shanley, O'Neil and Baker

[57] ABSTRACT

Arrangement including the use of at least two novel dual work roll supporting devices for supporting new or refinished work rolls on one device and a used work roll and mounted chock assemblies on another device, in the same relative relationship to permit removal of the chock assemblies as units from the used work rolls and mounting of the chock assemblies on new or refinished work rolls without requiring disengagement of the top and bottom work roll chocks.

7 Claims, 8 Drawing Figures

METHOD AND APPARATUS FOR CHANGING ROLLS FOR A ROLLING MILL

FIELD OF THE INVENTION

This invention relates to the changing of rolls of a rolling mill of the type in which top and bottom work rolls and their supporting chock assemblies are removed from and returned to the rolling mill as unitary structures. More particularly, the present invention relates to a method of and apparatus for removing chock assemblies from used top and bottom work rolls when outside the rolling mill and for mounting such chock assemblies on new or refinished top and bottom work rolls to provide a unitary structure for placement in the rolling mill.

BACKGROUND OF THE INVENTION

In accordance with conventional practice, top and bottom work rolls and their supporting chock assemblies are removed from or moved into a rolling mill as unitary structures by means of tracks located on the operating side of the mill which extend in a direction parallel to the axes of the work rolls. In the case of used top and bottom work rolls, the unitary structure is lifted from the tracks and placed on a transport car and moved to the roll shop. In accordance with the prior art practice, the following operations are performed at the roll shop to remove chock assemblies from used work rolls and to mount such chock assemblies on new or refinished top and bottom work rolls to provide a unitary structure to be returned to and mounted in the rolling mill:

1. Disengage both chock assemblies to permit the top work roll and its chock to be removed from the bottom work roll and its chocks.
2. Lift the top work roll and its chocks and place on a first support with the outer end portions of the working surface of the top work roll supported on wooden blocks and with each chock located above a path of movement of a different chock car.
3. Lift the bottom work roll and its chocks and place on a second support similar to the first support with the chocks located above the path of movement of the chock cars.
4. Place two new or refinished work rolls on separate supports similar to the first support with both ends of each work roll overlying the path of movement of the chock cars.
5. By use of chock cars, remove the chocks from the used top work roll and mount the chocks on a new or refinished work roll.
6. By use of the chock cars, remove the chocks from the used bottom work roll and place the chocks on a new or refinished work roll.
7. Lift from the support the new or refinished work rolls with chocks thereon and place the assembly on the transport car.
8. Lift from the support the new or refinished top work rolls with chocks thereon and place that assembly on the new or refinished bottom work roll and assembled chocks supported by the transport car.
9. Re-engage the chocks on the new or refinished top and bottom work rolls at both ends of the work rolls to provide a unitary structure of new or refinished work rolls and chock assemblies for movement to the rolling mill.

It is a primary object of the present invention to eliminate many of the foregoing operational steps of the prior art practice and provide essentially a four-step process which materially reduces the time required to make up a unitary structure of new or refinished work rolls and chock assemblies using chock assemblies from a unitary structure including used work rolls.

This object is achieved by a novel method and apparatus provided by the present invention for removal of chock assemblies from the top and bottom used work rolls and placing of such chock assemblies on new or refinished top and bottom work rolls which eliminates the necessity and the attendant prior art operational steps of disengaging from each other the top work roll chock and the bottom work roll chock of the chock assemblies.

Other objects and features of the present invention will appear from the following detailed description considered with the accompanying drawings which illustrate the preferred embodiment of the invention.

DESCRIPTION OF PRIOR ROLLING MILL APPARATUS

Figure 1:
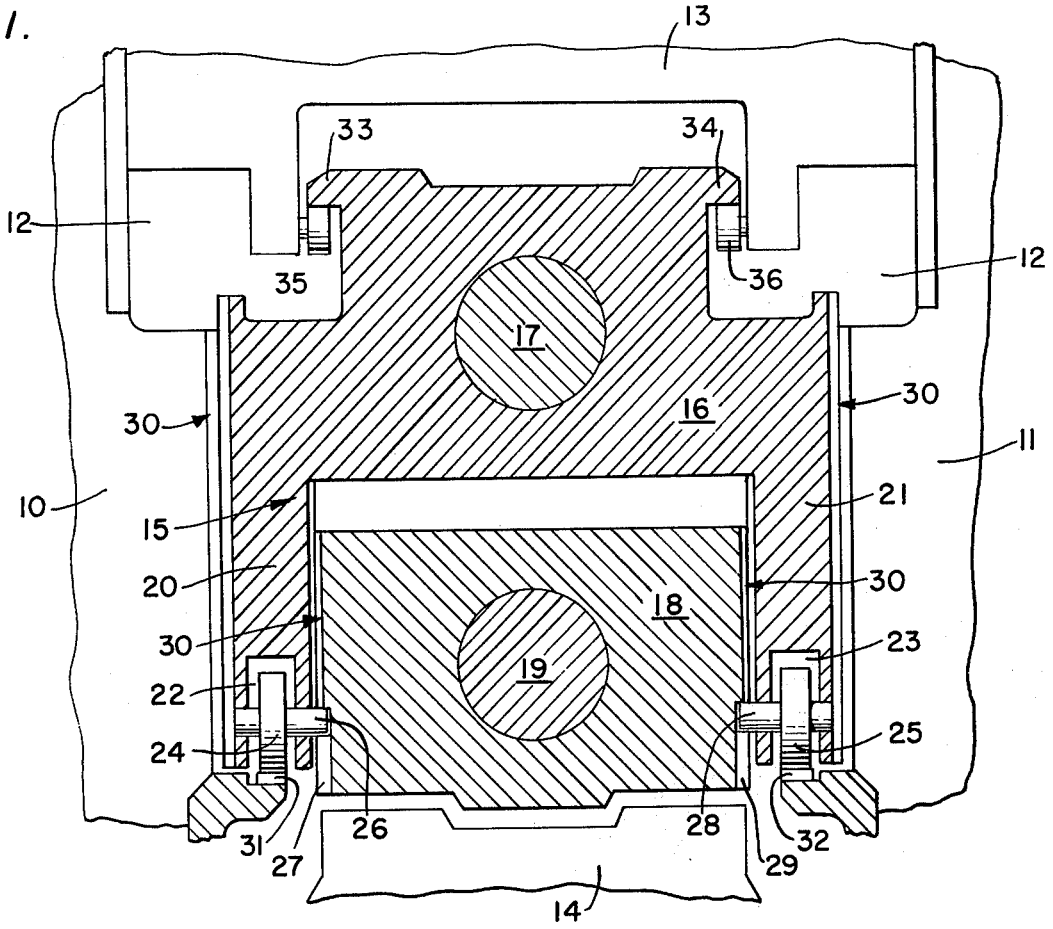
FIG. 1 is a fragmentary diagrammatic showing, partially in section, of a rolling mill with the top and bottom work rolls and the chock assembly positioned to be removed from the rolling mill as a unitary structure.

As mentioned above, it is common practice in the art of rolling mills to provide structure that permits the top work roll and the bottom work roll and the chock assemblies at both ends of the work rolls to be removed from the rolling mill or to be moved into the rolling mill as a unitary structure. A typical arrangement shown in FIG. 1 includes upright housings 10 and 11 providing a window 12 within which is mounted a chock 13 for the top backup roll, not shown, a chock 14 for the bottom backup roll, not shown, and a chock assembly 15 including chock 16 for the top work roll 17 and chock 18 for the bottom work roll 19. The top work roll chock 16 is provided with a pair of spaced-apart, downwardly depending leg portions 20 and 21 between which is nested the bottom work roll chock 18. The lower ends of the leg portions 20 and 21 are provided with downwardly opening slots 22 and 23, respectively, in each of which is mounted a wheel 24 and 25, respectively. The wheel 24 is supported by a shaft 26 which extends laterally into a downwardly open end slot 27 formed in the adjacent surface of the lower work roll chock 18. Similarly, the wheel 25 is supported by a shaft 28 which extends laterally into a downwardly open end slot 29 formed in the opposite adjacent surface of the bottom work roll chock 18. Thus, the bottom work roll chock 18 is movable relative to the top work roll chock 16 and the extent of relative downward movement is limited by engagement of shafts 26 and 28 with the closed ends of slots 27 and 29, respectively. In accordance with conventional practice, liners 30 may be provided where there is relative movement between adjacent surfaces of the top and bottom work roll chocks 16 and 18 and between the housings 10 and 11 and the chocks 13, 14 and 16.

FIG. 1 shows the top and bottom work rolls and their chock assemblies positioned to be removed from the rolling mill as a unitary structure. Upward movement of the top backup roll chock 13 positions the top work roll chock 16 to be supported by the wheels 24 and 25 which ride on rails 31 and 32, respectively, supported by the housings, and by outwardly extending portions 33 and 34 of the top work roll chock 16 which ride on wheels 35 and 36, respectively, supported by the top backup roll chock 13. The bottom work roll chock 18 is supported by the shafts 26 and 28 in contact with the closed ends of respective slots 27 and 28 and is in its maximum downward position relative to the top work roll chock 16. When the bottom work roll chock 18 is at its maximum downward position, the top surface 37 of the lower work roll chock 18 is spaced vertically a maximum distance from the adjacent bottom surface 38 of the top work roll chock 16.

Figure 2:
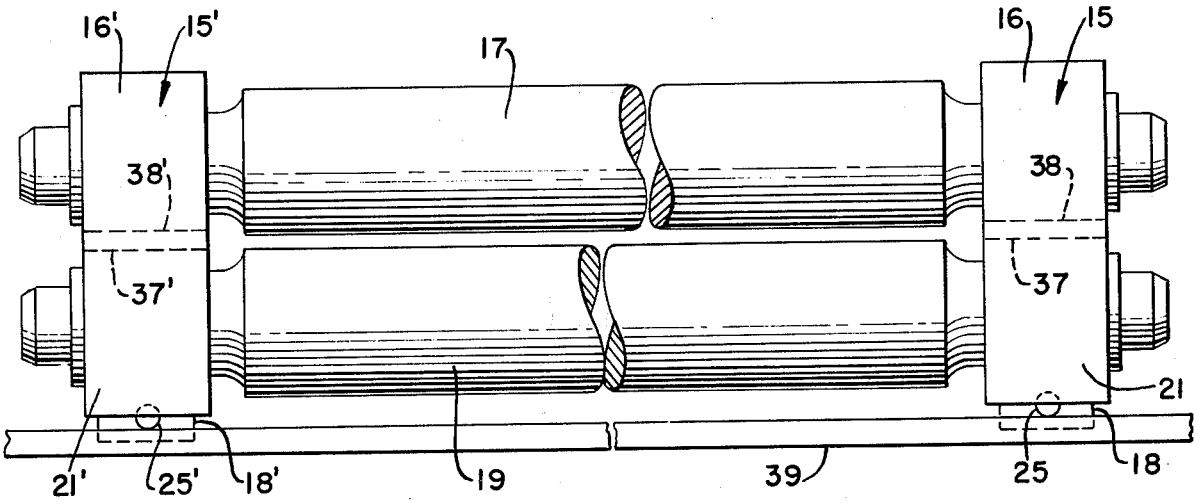
FIG. 2 is a diagrammatic view in side elevation of a unitary structure including top and bottom work rolls and chock assemblies positioned outside the rolling mill.

Parallel tracks, which are extensions of the rails 31 and 32, are provided on the operating side of the rolling mill to permit the top and bottom work rolls and each chock assembly to be removed from the mill as a unitary structure. FIG. 2 illustrates such unitary structure located outside the rolling mill, the chock assembly for the other ends of the working rolls and its component parts being designated by primed reference characters. As shown, the unitary structure is supported on track 39 by wheels 25 and 25', the other parallel track and the supporting wheels not shown in the drawing.

In the case of a unitary structure including used work rolls, from the position shown in FIG. 2 the unitary structure is lifted and placed on a transfer car where the structure is supported by the lower work roll chocks 18 and 18', and moved to the roll shop where the novel method and apparatus provided by the present invention are practiced.

DESCRIPTION OF PREFERRED EMBODIMENT

The present invention provides a novel dual work roll supporting device for supporting as a unitary structure the top and bottom work rolls and a mounted chock assembly at both ends of the work rolls in such a manner as to permit each chock assembly to be removed from the work rolls as a unitary structure, that is, without requiring disengagement of the top work roll chock and the bottom work roll chock, and to thereafter mount each removed chock assembly on a pair of new or refinished work rolls supported by a similar dual work roll supporting device.

Figure 3:
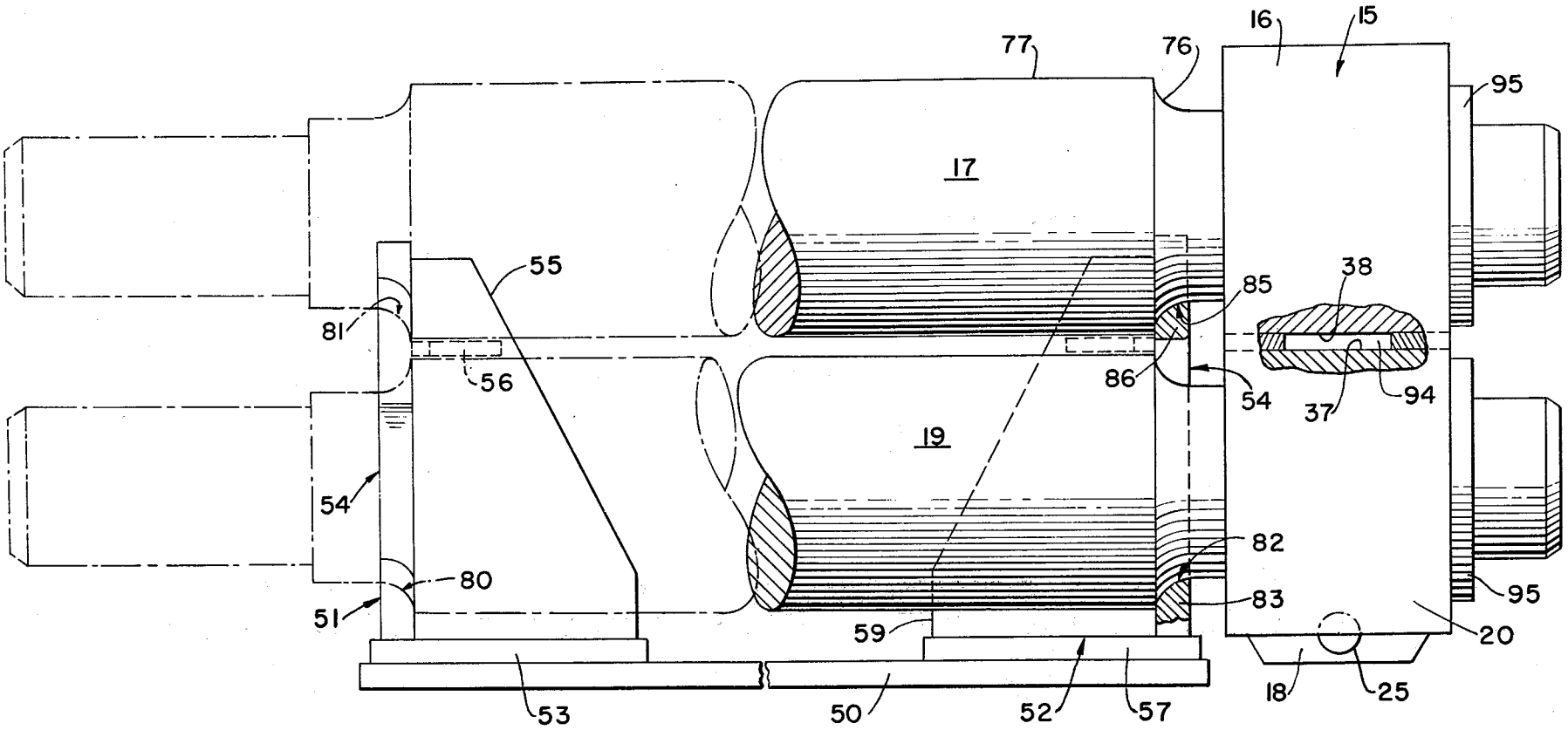
FIG. 3 is a diagrammatic view in side elevation, partially in section, of the dual work roll supporting device provided by the present invention in operative relation with top and bottom work rolls and a chock assembly.

As shown in FIG. 3, the dual work roll supporting device provided by the present invention includes a base structure 50 on which are mounted dual work roll end supports 51 and 52 in fixed relative relation to support the top work roll 17 and the bottom work roll 19 by contact with portions of the work rolls axially inwardly of each chock assembly in such a manner as to support the top and bottom work rolls with a chock assembly mounted on each of their ends, to permit each chock assembly to be removed as a unitary structure and to permit each removed chock assembly to be mounted as a unitary structure on the ends of top and bottom work rolls supported by a similar device. The dual work roll end support 51 includes a horizontal base plate 53, an upstanding member 54, a reinforcing plate 55 and a gusset plate 56 each fabricated from steel plate and joined together, such as by welding, to form a rigid structure. In like manner, the dual work roll end support 52 is a rigid structure including a horizontal base plate 57, an upstanding member 58, a reinforcing plate 59 and a gusset plate 60. The dual work roll end supports 51 and 52 are mirror images of each other and details of both will be appreciated from FIGS. 4, 5, 6, and 7 which illustrate details of the work roll end support 51.

As shown in FIGS. 4, 5, 6, and 7, the upstanding member 54 includes a lower or first laterally extending portion 61 terminating in an end 62 and an upper or second laterally extending portion 63 terminating in an end 64, the extending portion 63 being located in spaced relation above the extending portion 61 to provide an opening 65 in the upstanding member which has a lateral entrance lying in a plane passing through the ends 62 and 64. The extending portions 61 and 63 have upwardly facing surfaces 66 and 67, respectively, and each upwardly facing surface includes a curved roll supporting surface having a center of curvature corresponding to the curvature of a portion of the rolls to be supported so that the curved roll supporting surface receives in snug supporting relation a curved surface of a roll to be supported. In particular, the roll supporting surface on the extension 61 lies between points 68 and 69 and has a center of curvature at point 70 while the roll supporting surface on the upper extending portion 63 lies between points 71 and 72 and has a center of curvature at point 73. The centers of curvature 70 and 73 lie in a common vertical plane 74 to permit support of the working rolls in the same relative position as exists when the working rolls are mounted in the rolling mill and the centers of curvature 70 and 73 are spaced height-wise to permit the work rolls to be supported when a chock assembly is mounted on each end of the work rolls and also to permit chock assemblies to be mounted on a pair of work rolls supported by a similar device. The arcuate dimensions of the roll supporting surfaces are sufficient to stably support the work rolls to permit chock assemblies to be removed from and mounted on supported work rolls. Roll supporting surfaces extending about 40° from both sides of the plane 74 of the centers of curvature are adequate for supporting 24 inch diameter work rolls. However, the provision of the roll supporting surface 68–69 with the terminating point 69 lying in a horizontal plane passing through the center of curvature 70 aids in moving the lower work roll into supporting relation with the roll supporting surface 68–69.

The opening 65 in the upstanding member 54 is defined by the roll supporting surface extending between points 68 and 69 and by an upper non-roll supporting surface extending between the terminating end of the roll supporting surface at point 69 and point 75 at the end 64 of the extending portion 63. In order to permit the portion of the roll to be supported to pass through the entrance and enter the opening 65 and move into snug relation with the roll supporting surface of the extending portion 61, the non-roll supporting surface between points 69 and 75 is spaced from the center of curvature 70 at all points along the non-roll supporting surface a distance greater than the radius of curvature of the roll supporting surface 66–68 with the distance gradually increasing in a direction toward the point 75 to facilitate entrance of the surface of the roll to be supported into the opening 65 and into snug supporting relation with the roll supporting surface 68–69.

As shown in FIG. 3, conventional work rolls include a concave circumferential surface 76 outwardly of both ends of the working surface 77 of the rolls. In accordance with the principles of the present invention, the roll supporting surfaces 68–69 and 71–72 comprise convex surfaces curved to snugly contact a portion of the concave surface 76 of the rolls to be supported and the width of the supporting surfaces 68–69 and 71–72 between the sides 78 and 79 of the upstanding member 54 corresponds to the axial dimension of the concave surfaces 76 of the rolls. This feature provides support for the rolls in an axial direction which aids in removing and mounting chock assemblies as described below.

Figure 4:
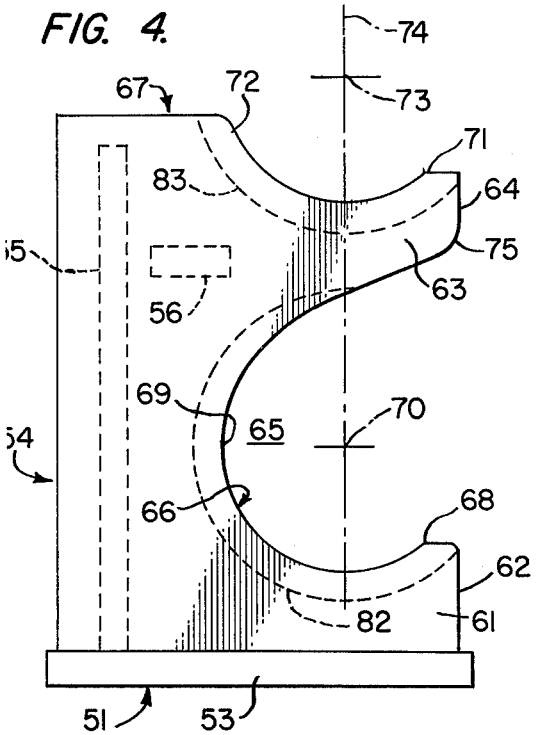
FIG. 4 is an end view of a dual roll end support forming a part of the device shown in FIG. 3.
Figure 5:
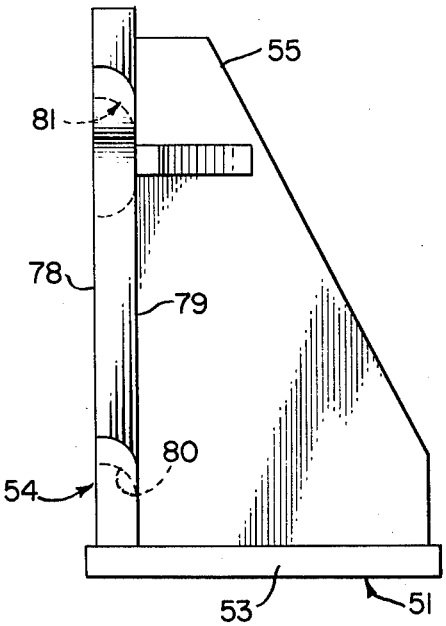
FIG. 5 is a view in side elevation of the dual roll end support shown in FIG. 4.
Figure 6:
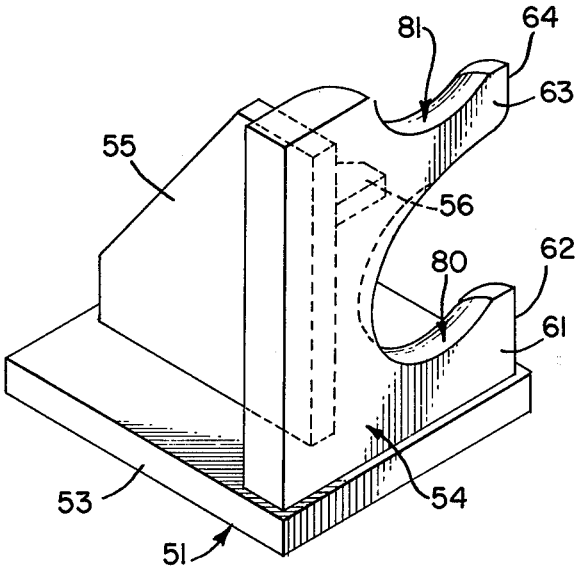
FIG. 6 is a three-dimensional view of the dual roll end support shown in FIGS. 4 and 5.
Figure 7:
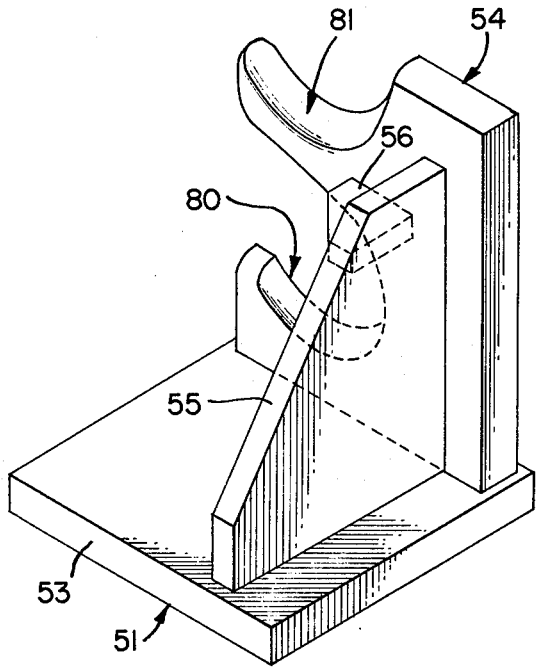
FIG. 7 is another three-dimensional view of the dual roll end support structure shown in FIGS. 4 and 5.

In FIGS. 5, 6 and 7, the convex roll supporting surface on the extending portion 61 is designated by reference character 80 and the convex roll supporting surface on the upper extending portion 63 is designated by the reference character 81. In FIG. 4, the dotted lines 82 and 83 identify the large diameter edges of the convex roll supporting surfaces 80 and 81, respectively. The convex surface extends throughout the arcuate dimension of the roll supporting surfaces 68–69 and 71–72 and, as seen in FIG. 4, extends into the non-roll supporting surface 69–75 at least to the vertical plane 74 to permit free movement of the rolls to be supported into the opening 65. FIG. 3 shows the top and bottom work rolls 17 and 19 supported by the dual work roll end supports 51 and 52 with roll supporting surfaces in contact with the concave circumferential surfaces 76 at both ends of the rolls. In particular, a circumferential portion of the concave surface 76 at the left-hand end of the rolls, as viewed in FIG. 3, is supported by the convex roll supporting surfaces 80 and 81 and a circumferential portion of the concave surface 76 at the right-hand end of the rolls, as viewed in the drawing, is supported by convex roll supporting surfaces on the upstanding member 58 of the roll end supporting device 52; a convex roll supporting surface 82 being formed on the lower extension portion 83 of the upstanding member 58 and a convex roll supporting surface 85 being formed on the upper extending portion 86.

As shown in FIG. 3, the roll end supports 51 and 52 are secured to the base structure 50 with their upstanding members 54 and 58, respectively, lying in parallel planes which are spaced from each other by a distance equal to the axial length of the working surface 77 of the rolls 17 and 19. Also, the roll end supports 51 and 52 are positioned relative to each other so that the centers of curvature of the roll supporting surface on the lower extensions of both roll end supports lie on a common axis and so that the centers of curvature of the roll supporting surfaces on the upper extensions of both roll end supports lie on a second common axis parallel to and spaced above the common axis of the centers of curvature of the lower roll supporting surfaces. For a purpose that will become apparent below, the vertical spacing between the parallel axes passing through the centers of curvature is less than the maximum vertical distance between the top surface 37 of the lower work roll chock 18 and the bottom surface 38 of the top work roll chock 16 which occurs when the chock assembly is supported by the upper work roll chock 16. As seen in FIG. 3, the reinforcing plates 55 and 59 extend from their respective upstanding members 54 and 58 toward each other and, as seen from FIG. 4, the reinforcing plates 55 and 59 lie in a plane displaced from the plane 74 of the centers of curvature to provide space for the working surface portion of the rolls to be supported between the upstanding members 54 and 58.

Figure 8:
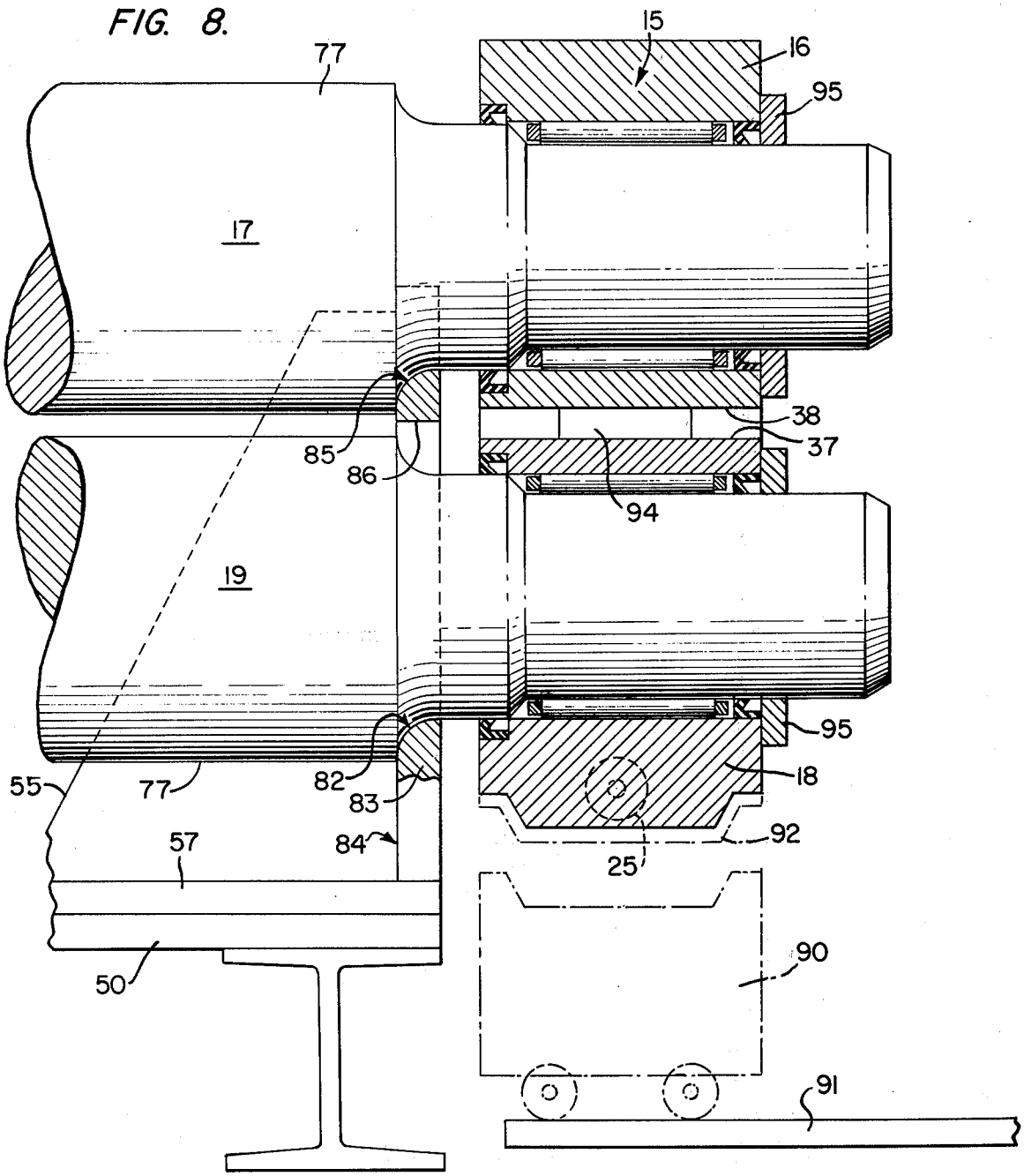
FIG. 8 is a diagrammatic view in elevation of the dual roll end support provided by the present invention in operative relation with top and bottom work rolls and a chock assembly.

In accordance with the principles of the present invention, a plurality of dual work roll supporting devices constructed in the manner described above and shown in FIG. 3 are mounted on a platform in spaced parallel relationship, that is, with the common axes passing through the centers of curvatures of the roll supporting surfaces of each dual work roll supporting device lying in parallel planes which are spaced from each other by a distance sufficient to provide space for operations performed to remove chock assemblies from and mount chock assemblies on the supported top and bottom work rolls. Each of the plurality of dual work roll supporting devices have similar critical dimensions to support the top and bottom work rolls of a family of top and bottom work rolls having similar shapes and dimensions. In particular, each of the plurality of dual roll supporting devices have: roll supporting surfaces of similar radius of curvature comparable with the curvature of supported surfaces of the top and bottom work rolls; the same vertical distance between the center of curvature of the bottom roll supporting surface and the top roll supporting surface, and similar axial distances between the facing sides 78 and 79 of the upstanding members which correspond to the axial dimension of the working surface 77 of the rolls. At both sides of the platform, outwardly of and at an elevation below the roll end supporting devices 51 and 52 of each of the plurality of dual roll supporting devices, tracks are provided for supporting a chock car that is movable to positions adjacent each of the plurality of dual roll supporting devices such as a position beneath a chock assembly mounted on supported top and bottom work rolls for use in removing the chock assembly or a position outwardly from the ends of supported work rolls for use in mounting on the work rolls a chock assembly carried by the chock car. In FIG. 8 of the drawings, which is an enlarged view of the right-hand end of the dual work roll supporting device of FIG. 3 with the chock assembly 15 shown partly in cross section, a chock car 90 is shown mounted on rails 91 and located beneath the chock assembly 15 in a position to be moved upwardly to support the chock assembly 15 by engaging the lower work roll chock 18.

In practicing the method of the present invention, new or refinished work rolls are supported on one of the dual work roll supporting devices in the manner shown in FIG. 3 with the exception that the chock assembly 15 would not be present. This is accomplished by lifting the work rolls separately by use of a suitable sling into supporting engagement with the roll supporting surfaces; the lower work roll being moved laterally and downwardly into the opening 65 with the inclined surface between plates 69 and 75, FIG. 4, aiding in guiding the lower work roll into supporting relation with the lower roll supporting surfaces. When a unitary structure comprising a pair of used work rolls with a chock assembly mounted at both ends, such as shown in FIG. 2, arrives from the rolling mill on the transport car, the unitary structure is lifted from the transport car by use of a suitable sling and mounted on another of the plurality of dual work roll supporting devices as shown in FIG. 3 with the exception that the chock assembly 15' would be mounted on the left-hand ends of the work rolls 17 and 18. The mounting operation is performed in a manner similar to the mounting of the new or refinished rolls on a dual roll supporting device, as described above; however, the top and bottom work rolls and the mounted chock assemblies 15 and 15' are lifted and mounted as a unitary structure.

When the unitary structure is mounted on a dual work roll supporting device, as shown in FIG. 3, since the roll supporting surfaces 80–82 and 81–85 snugly receive in supporting relation a portion of the concave surfaces 76 of the top and bottom work rolls, respectively, the longitudinal axis of the top work roll 17 and the central axes of the bearing surfaces of the top work roll chocks 16 and 16' pass through the centers of curvature of the work roll supporting surfaces 81 and 85 and the longitudinal axis of the lower work roll 19 and the central axes of the lower work roll chocks 18 and 18' pass through the centers of curvature of the work roll supporting surfaces 80 and 82. Furthermore, the longitudinal axes of the work rolls are spaced vertically from each other by a fixed distance determined by the vertical spacing between the centers of curvature 70 and 71 of the roll supporting surfaces. In each chock assembly, the lower work roll chocks are supported in fixed relation to the top work roll chock determined by the vertical distance between the centers of curvature 70 and 73. Since the vertical space between the centers of curvature is less than the vertical space between the central axes of the bearings of the upper and lower work roll chocks 16 and 18 when the lower chock is supported only by the upper chock, the vertical space between the top surface 37 of the bottom work roll chock 18 and the bottom surface 38 of the top work roll chock 16 is less than the vertical spacing that would exist if the lower work roll chock was free to reach its maximum downward position relative to the top work roll chock 16. This is shown in FIG. 8 wherein the dotted outline 92 represents the relative maximum downward position of the lower work roll chock if it was permitted to move freely relative to the top work roll chock.

After the unitary assembly is moved to be supported by a dual work roll supporting device, a spacer or shim 94 is inserted in snug relation between the top surface 37 of the lower work roll chock 18 and the bottom surface 38 of the top work roll chock 16 in order to maintain constant the relative positions between the upper work roll chock 16 and the lower work roll chock 18 when the chock assembly 15 is supported by the lower work roll chock 18 and removed from the work rolls 17 and 19. In particular, with reference to FIG. 8, the chock car 90 is moved upwardly in contact with the lower work roll chock 18 to support the load of the chock assembly. Thereupon, after the thrust rings 95 are removed, the chock car is moved axially away from the work rolls while at the same time a lateral force is applied to the chock assembly by means not shown to move the chock assembly from the work rolls. The removed chock assembly is then moved by the chock car to a position adjacent the ends of the new or refinished rolls supported by the dual work roll supporting device discussed above. Since the longitudinal axis of the new or refinished work rolls and the central axes of the bearings of the chock assembly are equally vertically spaced, due to the presence of the spacer 94, an inward lateral force is applied to the chock assembly and the chock car is moved inwardly to mount the chock assembly on the new or refinished work rolls. Thereafter, the spacer 94 is removed and the thrust rings 95 replaced and, when a chock assembly is mounted on the other ends of the work rolls, the unitary assembly is lifted from the dual work roll device, placed on the transport car and moved to the rolling mill.

The present invention thus provides a fourstep process for changing chock assemblies, i.e., (1) mounting new or refinished work rolls on a dual work roll supporting device; (2) mounting as a unitary structure used work rolls and chock assemblies on a dual work roll supporting device; (3) removing chock assemblies as unitary structures from the used work rolls and mounting such chock assemblies on the supported new or refinished work rolls; and (4) removing from the dual work roll supporting device the new unitary structure comprising new or refinished work rolls and mounted chock assemblies.

There is thus provided by the present invention a novel method and apparatus which greatly simplifies the operations and materially reduces the time previously required for changing chock assemblies from used work rolls to new or refinished work rolls. It will be appreciated that features and details of the preferred embodiment disclosed and described herein may be modified without departing from the spirit of the invention. For example, the roll supporting surfaces of the dual roll supporting device may be shaped to conform to other surfaces of the work rolls such as the marginal edges of the working surface of the rolls or the constant diameter portion of the rolls between the chock assemblies and the concave circumferential surface. Accordingly, reference will be had to the accompanying claims for a definition of the limits of the invention.

What is claimed is:

1. Dual roll supporting device comprising

A. a pair of spaced-apart upstanding members mounted on a base,

B. each upstanding member including:

a. first and second laterally extending portions having terminating ends, the second extending portion being located in spaced relation above the first extending portion to provide an opening in the upstanding member having a lateral entrance located in a plane passing through the terminating ends, the second extending portion having a limited vertical dimension at its terminating end to laterally fit between a pair of top and bottom parallel rolls of a dual roll assembly to be supported by the device, b. the first extending portion having an upwardly facing surface and the second extending portion having an upwardly facing surface, c. a first curved roll supporting surface formed on the upwardly facing surface of the first extending portion, d. a second curved roll supporting surface formed on the upwardly facing surface of the second extending portion and terminating adjacent the terminating end of the second extending portion at an elevation below the highest elevation of the second curved roll supporting surface, e. each roll supporting surface having a center of curvature to receive in snug supporting relation a curved surface of a roll to be supported, f. the opening in the upstanding member being defined by the roll supporting surface on the first extending portion and by a non-roll supporting surface extending between the terminating end of the second extending portion and the roll supporting surface on the first extending portion, all points on the non-roll supporting surface being spaced from the center of curvature by a distance greater than the radius of curvature, C. the center of curvature of the roll supporting surface on the first extending portion of both of the upstanding members lying on a first axis, and D. the center of curvature of the roll supporting surface on the second extending portion of both of the upstanding members lying on a second axis spaced from and parallel to the first axis, E. and wherein the centers of curvature of all of said roll supporting surfaces lie in the same vertical plane and wherein the roll supporting surfaces of the first extending portion of both of the upstanding members are mirror images of each other having the same radius of curvature and extending along the same cylindrical surface of revolution, and wherein the roll supporting surfaces of the second extending portion of both of the upstanding members are mirror images of each other having the same radius of curvature and extending along the same cylindrical surface of revolution, F. and wherein the terminating ends of both of said first and second laterally extending portions respectively lie below horizontal planes passing through said first and second axes of said centers of curvature.

2. Dual roll supporting device as defined by claim 1 in which the non-roll supporting surface of each of the upstanding members includes a portion inclined downwardly from the end of the second extending portion in a direction away from the entrance to the opening.

3. Dual roll supporting device as defined in claim 1 wherein the outer limit of the curved roll supporting surfaces of the first extending portions of the upstanding members is positioned approximately 40° from the vertical plane of their centers of curvature when measured from their centers of curvature.

4. Dual roll supporting device comprising

A. a pair of spaced-apart upstanding members mounted on a base,

B. each upstanding member including:

a. first and second laterally extending portions having terminating ends, the second extending portion being located in spaced relation above the first extending portion to provide an opening in the upstanding member having a lateral entrance located in a plane passing through the terminating ends, the second extending portion having a limited vertical dimension at its terminating end to laterally fit between a pair of overlying parallel rolls of a dual roll assembly to be supported by the device, b. the first extending portion having an upwardly facing surface and the second extending portion having an upwardly facing surface, c. a first curved roll supporting surface formed on the upwardly facing surface of the first extending portion, d. a second curved roll supporting surface formed on the upwardly facing surface of the second extending portion and terminating adjacent the terminating end of the second extending portion at an elevation below the highest elevation of the second curved roll supporting surface, e. each roll supporting surface having a center of curvature to receive in snug supporting relation a curved surface of a roll to be supported, f. the opening in the upstanding member being defined by the roll supporting surface on the first extending portion and by a non-roll supporting surface extending between the terminating end of the second extending portion and the roll supporting surface on the first extending portion, all points on the non-roll supporting surface being spaced from the center of curvature by a distance greater than the radius of curvature, C. the center of curvature of the roll supporting surface on the first extending portion of both of the upstanding members lying on a first axis, and D. the center of curvature of the roll supporting surface on the second extending portion of both of the upstanding members lying on a second axis spaced from and parallel to the first axis, E. and wherein the dual roll supporting device is adapted to support rolls of the type including a concave circumferential surface located outwardly of the working surface of the roll at both ends of the roll, and wherein each roll supporting surface of both upstanding members comprises a convex surface shaped to snugly receive a portion of the concave circumferential surface of a roll.

5. Dual roll supporting device as defined by claim 4 in which each convex roll supporting surface has a dimension measured along the first axis corresponding to the axial dimension of the concave circumferential surfaces of the roll to be supported, and in which the distance measured along the first and second axes between the convex roll supporting surfaces of both upstanding members corresponds to the axial distance between the concave circumferential surfaces at opposite ends of the roll to be supported.

6. For use in supporting a dual roll assembly including a pair of top and bottom generally parallel rolls supported to be handled together as a unit;

a supporting device comprising a pair of upstanding members positioned in laterally spaced side-by-side relationship, and providing upper and lower pairs of arcuate supporting surfaces dimensioned to respectively receive and support opposite surface portions of a pair of top and bottom parallel rolls of a dual roll assembly to be supported thereby, said upstanding members having projecting portions extending therefrom in the same direction and including said upper pair of arcuate surfaces, said projecting portions being limited in vertical dimension to laterally fit between the pairs of rolls when the rolls are received on said arcuate supporting surfaces whereby the devices may be simultaneously placed into supporting engagement with respect to both rolls of said pair of rolls, and wherein said supporting device is for use with a dual roll assembly including a pair of chock units supporting opposite ends of the pair of rolls, and wherein the opposite surface portions of the pair of rolls are located adjacent the chock units and have a diameter less than the diameter of the rolls intermediate the ends of the rolls thereby forming recesses adjacent the chock units, and wherein said projecting portions of the upstanding members are dimensioned to fit within said recesses to limit axial movement of the rolls relative to the device when supported on the arcuate supporting surfaces of the device, and wherein said supporting device is for use with a dual roll assembly wherein the opposite surface portions of the rolls have a concave cross section, and wherein the arcuate supporting surfaces are convex in cross section to snugly receive in complementary fashion the concave surfaces of the rolls.

7. Dual roll supporting device comprising

A. a base structure,

B. a pair of roll end supports each including:

a. a base plate fixed to said base structure, b. an upstanding member mounted on the base including a pair of height-wise spaced curved roll supporting surfaces each having a radius of curvature corresponding to the radius of curvature of a roll to be supported, C. the base plate of both roll end supports being secured to the base structure with the centers of curvature of pairs of corresponding roll supporting surfaces of both roll end supports, and with the common axes of one pair of corresponding roll supporting surfaces disposed above the common axes of the other pair of corresponding roll supporting surfaces, and wherein the common axes of corresponding pairs of roll supporting surfaces lie in a common vertical plane, and wherein each roll end support includes a reinforcing plate joined to the upstanding member and the base plate, each reinforcing plate extending in a direction toward the other reinforcing plate, and each reinforcing plate being spaced laterally from a plane passing through the common axes by a distance greater than the radius of the working surface of the rolls to be supported, D. and wherein the upstanding members each include first and second laterally extending portions which include said curved roll supporting surfaces, said laterally extending portions respectively terminating at outer ends below horizontal planes passing through said axes of said roll supporting surfaces.

* * * * *

UNITED STATES PATENT OFFICE

CERTIFICATE OF CORRECTION

PATENT NO. : 3,951,268

DATED : April 20, 1976

INVENTOR(S) : Raymond H. Pell

It is certified that error appears in the above-identified patent and that said Letters Patent are hereby corrected as shown below:

Column 6, line 67, "plates" should read -- points --.

Column 12, line 6, after "supports" and before the comma (,), insert -- being on a common axis --;

line 7, "axes" should read -- axis --;

line 9, "axes" should read -- axis --.

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*